US007972229B2

(12) United States Patent
MacDougall

(10) Patent No.: US 7,972,229 B2
(45) Date of Patent: Jul. 5, 2011

(54) BASEBALL BAT

(75) Inventor: John A. MacDougall, Bend, OR (US)

(73) Assignee: MacDougall & Sons Bat Company, LLC, Bend, OR (US)

( * ) Notice: Subject to any disclaimer, the term of this patent is extended or adjusted under 35 U.S.C. 154(b) by 123 days.

(21) Appl. No.: 12/460,353

(22) Filed: Jul. 17, 2009

(65) Prior Publication Data

US 2011/0015006 A1 Jan. 20, 2011

(51) Int. Cl.
*A63B 59/06* (2006.01)

(52) U.S. Cl. ..... 473/564

(58) Field of Classification Search ..... 473/457, 473/519, 520, 564–568
See application file for complete search history.

(56) References Cited

U.S. PATENT DOCUMENTS

| | | | | | |
|---|---|---|---|---|---|
| 795,815 | A | * | 8/1905 | Burrows | 473/564 |
| 813,400 | A | | 7/1906 | Buehler | |
| 1,549,803 | A | * | 8/1925 | Rastetter | 473/564 |
| 1,601,915 | A | * | 10/1926 | Hillerich | 473/564 |
| 1,706,680 | A | * | 3/1929 | Smith | 473/564 |
| 2,017,060 | A | | 11/1932 | Hillerich | |
| 2,458,919 | A | * | 1/1949 | Marsden | 473/564 |
| 4,572,508 | A | * | 2/1986 | You | 473/520 |
| 4,714,251 | A | | 12/1987 | Cook | |
| 5,490,669 | A | | 2/1996 | Smart | |
| 5,865,002 | A | | 2/1999 | Tapojarvi et al. | |
| 6,007,440 | A | | 12/1999 | Bender et al. | |
| 6,010,417 | A | | 1/2000 | Young et al. | |
| 6,334,823 | B1 | | 1/2002 | Holman | |
| 6,814,113 | B1 | | 11/2004 | Daniels | |
| 6,827,659 | B1 | | 12/2004 | Chen | |
| 7,114,419 | B2 | * | 10/2006 | Liess | 82/1.11 |
| 2005/0153801 | A1 | * | 7/2005 | Davis et al. | 473/564 |
| 2006/0030437 | A1 | | 2/2006 | Bao et al. | |
| 2007/0072710 | A1 | * | 3/2007 | Lo | 473/564 |
| 2007/0135246 | A1 | | 6/2007 | Davis et al. | |
| 2008/0308187 | A1 | | 12/2008 | Dill | |
| 2009/0275428 | A1 | * | 11/2009 | Ikeda et al. | 473/564 |

OTHER PUBLICATIONS

Picture of a Hoosier Woodforce 3000 bat, at least as early as Mar. 2009, one page.
Product description and picture of the Viper Bat Company, Inc. 360 Maple Bat characteristics and design, at least as early as Fall 2008, one page.
Product description including pictures of the Radial Bat characteristics and design, at least as early as Fall 2008, two pages.
Product description and pictures of a Rockbats' All-Wood Laminated Composite Bat "New for 2009," from rockbats.com website, four pgs. Actual date of listed art unknown.

* cited by examiner

*Primary Examiner* — Mark S Graham
(74) *Attorney, Agent, or Firm* — Chernoff Vilhauer LLP

(57) ABSTRACT

A novel baseball or softball bat is disclosed. The bat has a handle of a heavy, strong wood such as hickory, to resist breakage, and a barrel of a lighter wood such as sapele, to facilitate a controlled and comfortable swing. Methods for making the bat are also disclosed. It may be formed of a plurality of wedge-shaped pieces of wood, and the two species of wood may be joined by interleaving these wedges over part of the bat's length.

28 Claims, 3 Drawing Sheets

BASEBALL BAT

BACKGROUND OF THE INVENTION

The present invention is related to baseball and softball bats.

SUMMARY OF THE INVENTION

Baseball has been enjoyed by Americans for more than three-quarters of the Union's existence. Although for years technological development was slow, in recent decades the game has been dramatically transformed by changes in bat technology. The introduction of metal and composite materials has changed the game, some would argue for the worse. But it cannot be denied that bats made from materials other than wood have several advantages. They do not break as readily, can have their weight, balance, and feel easily tailored to suit consumer preferences and idiosyncrasies, and are easier for manufacturers to produce with a high level of uniformity because they are not subject to the natural variations of wood. However, there remain many players and fans who prefer wooden bats, and a number of leagues—Major League Baseball being the most prominent—that insist on wooden bats.

The present invention preferably provides a wooden bat that is stronger than those currently available, adjustable at the time of manufacture to give a "custom" combination of weight, balance, and hitting feel, and whose manufacture is subject to quality control in a manner not possible with other bat designs. The bat may optionally be given an appealing and distinctive visual appearance.

Features and advantages of the present invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
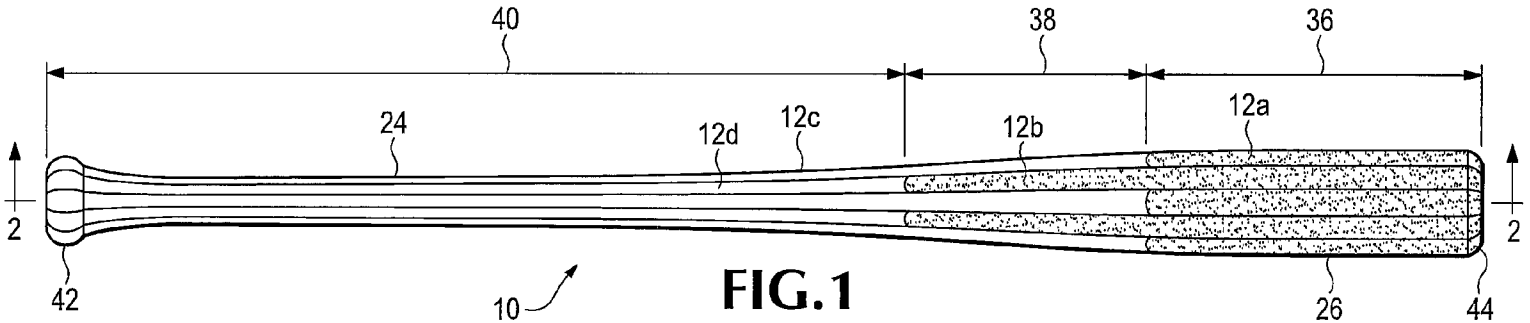
FIG. 1 is an elevation of an exemplary embodiment of the invention. Because it is cylindrically symmetrical, all elevations will look the same.
Figures 5, 6, 7:
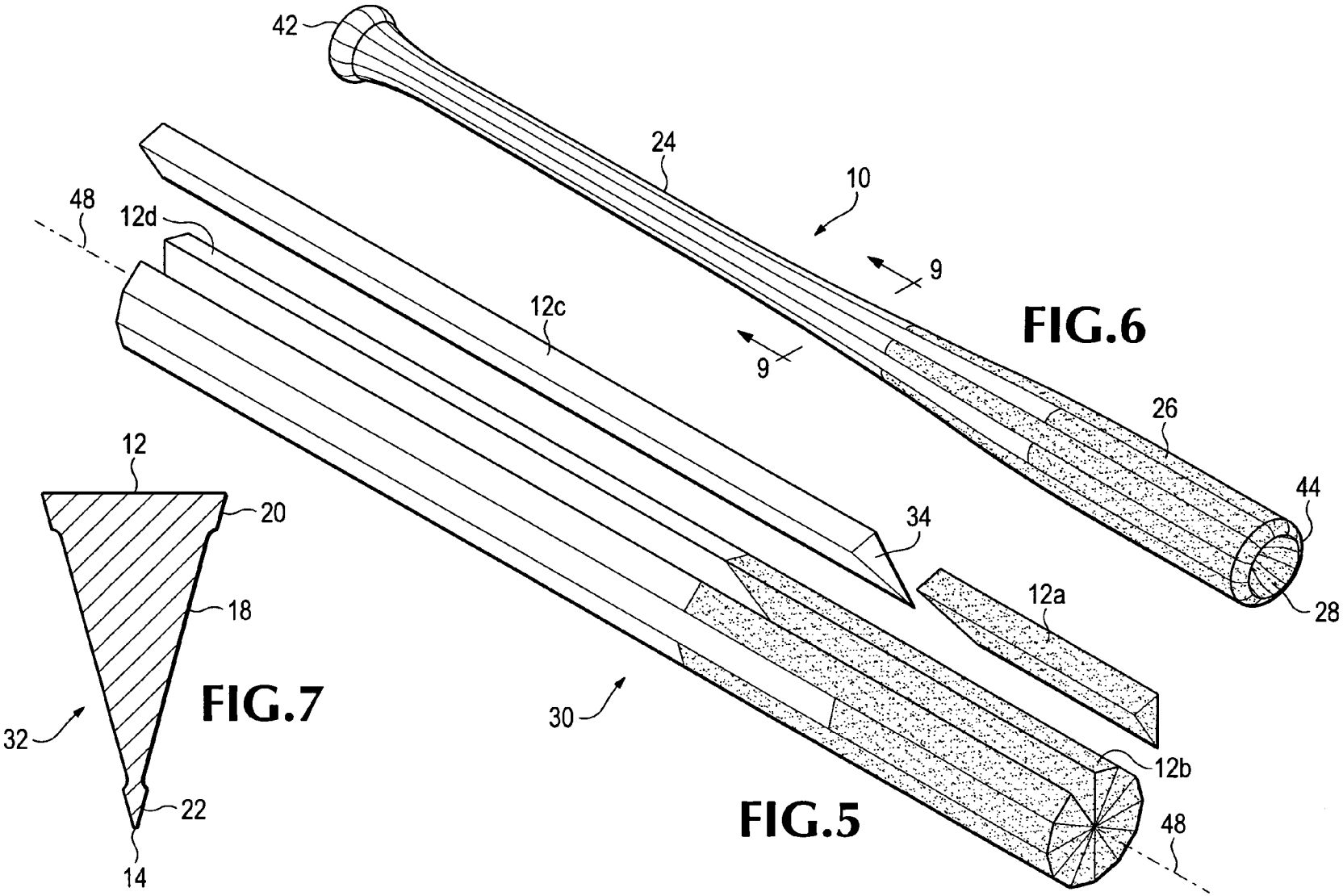
FIG. 5 is a partially exploded perspective view of an approximately cylindrical blank that is to be machined into the exemplary embodiment, showing the composition of the blank and the shape of the battens that make it up.
FIG. 6 is a perspective view of the exemplary embodiment.
FIG. 7 is a cross-sectional view an exemplary batten, with undercuts made in the sides exaggerated for clarity.

FIG. 1 shows an exemplary embodiment of the present invention. The bat 10 has an outer profile that is ordinary and may be chosen according to the preferences of the player and the rules of the league in which the bat is to be used. The bat is preferably composed of a number of wedge-like upper wooden battens 12*a* and 12*b*, and lower wooden battens 12*c* and 12*d*. These battens are preferably of different lengths, and prior to machining preferably have the form of an elongate triangular prism, as shown in FIGS. 5 and 7. It is also possible to use one set of battens, all the same length, which run the whole length of the bat 10.

Figure 9:
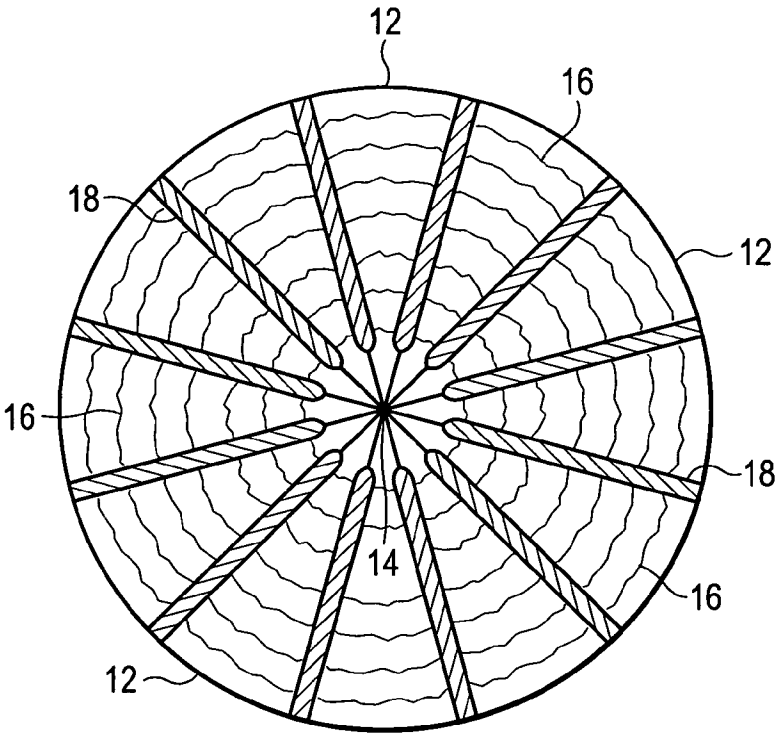
FIG. 9 is a partial cross-section of FIG. 1 along line 9-9, showing an exemplary embodiment of a wood grain arrangement in battens wherein the grain extends longitudinally along the batten and grain lines travel in a substantially circumferential direction. Glue gaps between the battens have been exaggerated for clarity.
Figure 8:
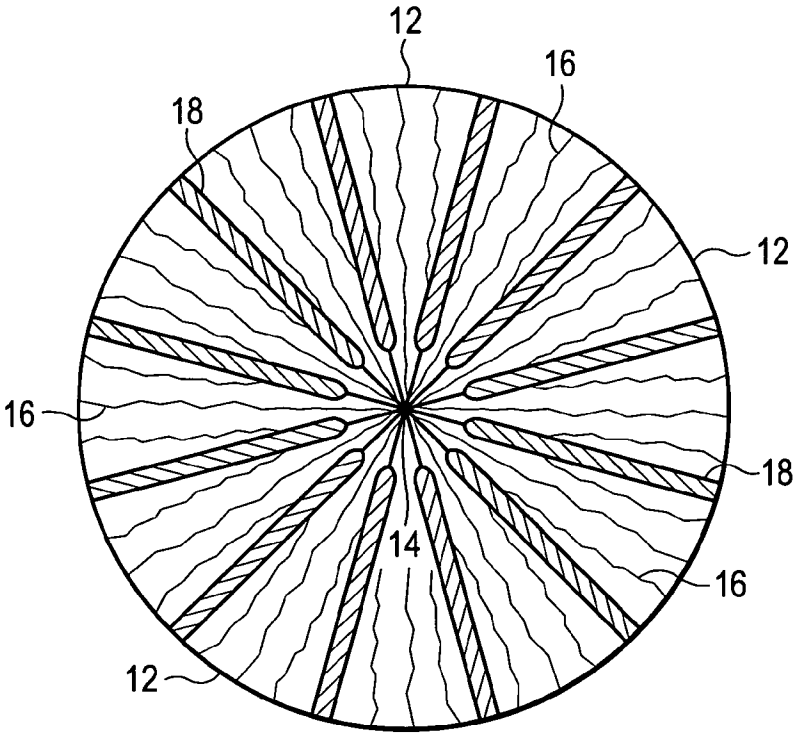
FIG. 8 is a partial cross-section of FIG. 1 along line 9-9, showing an exemplary embodiment of a wood grain arrangement in battens wherein the grain extends longitudinally along the batten and grain lines travel in a substantially radial direction. Glue gaps between the battens have been exaggerated for clarity.

Regardless of length, the battens may have a vertex 14 that may be cut at any angle that, when added to the angles of the other battens, will form a complete circle. Preferably, the number of battens is even, and they are preferably of substantially identical cross section, although alternate choices are also possible. Preferably, the number of battens is either 8 or 12. Also preferably, the battens are cut so that the grain of the wood runs longitudinally, and the grain lines 16 viewed in cross-section are either substantially radial or substantially circumferential, as shown in FIGS. 8 and 9. Preferably, the grain lines 16 are substantially the same in all battens so as to produce a bat that is substantially cylindrically symmetric.

FIG. 7 is an enlarged cross-sectional view of one of the battens. Each batten has two faces 32 adjacent a vertex 14. The center portion 18 of each face 32 may be slightly undercut, while the outer portions 20 and 22 are left undisturbed. Preferably, approximately 4-5 thousandths of an inch of material are removed to form the undercut. This has been exaggerated in the figure for the sake of clarity. When the battens are joined together as depicted in FIG. 5, the outer portions 20 and 22 are permitted to touch or are separated by only a very tiny glue gap, permitting proper alignment of the battens. Between the center portions 18 of two adjacent faces 32, a gap of 8-10 thousandths of an inch is formed. This allows glue to fill the joint for a secure bond, prevents a "starved joint" that lacks sufficient glue, and promotes proper alignment even in cases where the batten was originally formed with slight surface imperfections. Preferably, the center section 18 is slightly roughened, for example by the use of sandpaper, after the undercut is formed, to promote adhesion of the glue. This may be easily and quickly accomplished by the use of a belt sander with a narrow belt. When the bat is later machined, the outer portion 20 is typically removed over most or all of the bat's length.

The undercutting described above is typically necessary when the glue used to bond the bat comprises a two-part epoxy. The preferred embodiment uses this type of glue, which is strong, waterproof, and can cure without requiring special environmental conditions This contrasts with carpenter's glue (which requires a dry environment with air circulation) and single-component polyurethane glues (which require moisture). One suitable epoxy is "Gel Magic," manufactured by System Three Resins, Inc. of Auburn, Wash. However, other types of glue may alternatively be used, in which case the undercuts may be not only unnecessary, but undesirable. For instance, carpenter's glue shrinks when curing, which will leave air gaps in any undercuts and be detrimental to the strength of the joint.

The assembly process for bat 10 comprising a single set of full-length battens is straightforward. An appropriate number of battens are selected. The battens are weighed and marked with their weights. Some variation is inevitable with a natural material such as wood. A layout is selected whereby the resulting approximately cylindrical blank 30 is as nearly balanced about its axis 48 as is practical, to minimize vibration during the machining process later. The most convenient way to accomplish this end is to select battens for placement on opposite sides of the blank that are as nearly matched in weight as can be achieved from the selected battens. More sophisticated methods may also be employed, such as choosing the weights of neighboring battens to compensate for any remaining imbalance. In addition, the total weight of the bat may be adjusted by selecting different battens for inclusion in the set. In this way, nonuniformities in the wood from various trees may be evened out, resulting in greater bat-to-bat uniformity and improved consistency of performance. Alternatively, variations in total weight may be intentionally introduced in order to offer consumers a choice of bat weights in bats with otherwise identical dimensions. In either case, the manufacturer can exercise greater control over bat weight than is possible when using single-piece wood blanks.

After the battens have been selected for a particular bat, the appropriate glue is applied to their faces 32. The battens are then placed against one another, with the vertices 14 of the battens all meeting in the center at the axis 48 of the blank 30. Care should be taken to make this meeting of the vertices 14 as symmetrical about the axis as possible. When enough battens are in place to form a complete circle, and their alignment has been confirmed to be correct, the entire blank 30 is clamped to allow the glue to cure. This may be accomplished through the use of ordinary steel hose clamps, of the type found in auto parts and hardware stores, encircling the blank 30 perpendicular to and centered on the axis 48. This provides a symmetrical, radially directed force to push to battens towards the axis 48 and therefore into closer contact with one another during curing. The hose clamps may be shielded from contact with glue oozing from the joints between the battens by a barrier wrapped around the assembled blank. The barrier may be any material impervious to the glue, such as polyethylene sheeting or wax paper. Preferably, it is thin and light enough that it has minimal influence on the alignment of the battens and the tension in the hose clamps, and also preferably, it does not stick to the glue being used.

When the glue is cured, the finished blank 30 is released from the clamps and the barrier is removed. The blank 30 may then be machined into its final shape by means that are well known to those skilled in the art. Typically, this is accomplished by turning the blank 30 on a lathe. Preferably, the lathe is automated to minimize the need for human intervention, which is costly and introduces undesirable variation into the manufacturing process. For example, a hydraulic copy lathe may be employed, which adjusts the position of a gouge or other cutting implement based upon a template. CNC techniques or hand-turning are also possible. The final profile of the bat is determined by the rules of the league where the bat is intended to be used, and by consumer preferences. In an exemplary embodiment, a hollow 28 is formed at the end to lighten the bat slightly and adjust the position of the center of gravity. The shape of the hollow 28 is also regulated by the rules of the league. After turning, the bat may be sanded and finished as desired.

A single bat may be constructed from two or more different types of wood. Such construction permits the adjustment of the weight, moment of inertia, and location of the center of gravity by selecting woods of different densities and other properties, and adjusting the profile of the bat to best take advantage of these properties. Hickory is strong, so that bats constructed-from it are unlikely to break, but it is also heavy, such that an all-hickory bat is difficult to swing accurately, particularly at a breaking ball. Accordingly, the preferred embodiment employs hickory for the battens 12*c* and 12*d* of the handle section 24, which is the most easily broken part, and a less-dense hardwood, for example sapele, for the battens 12*a* and 12*b* of the barrel section 26. Thus, the bat 10 is lighter than a hickory bat, but stronger than a non-hickory bat. Any other combination of woods yielding the desired characteristics is possible.

In addition to their mechanical properties, the woods used in the bat 10 may be chosen for an attractive or distinctive appearance, or the woods may be stained for the same effect. For example, sapele is a dark wood, similar to mahogany, but hickory is a light-colored wood, so that the combination yields a striking and unusual impression on the eye. A light-colored wood, such as ash or maple, could also be chosen in place of the sapele to give a more conventional looking bat, or the hickory could be stained to match the sapele, yielding a dark but single-colored bat. In the event that two woods of similar colors are chosen for their mechanical properties, the appearance of the hickory-sapele combination can also be simulated by the careful application of stain.

Figure 2:
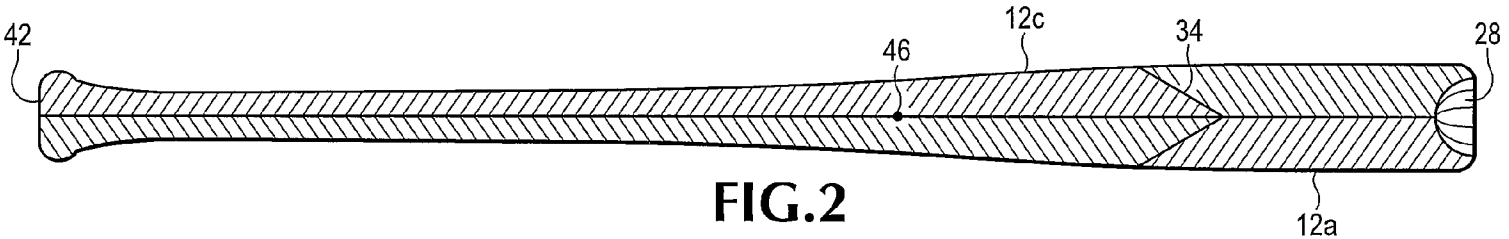
FIG. 2 is a cross section along the line 2-2 of FIG. 1, showing the internal composition of the bat and the cup-shaped hollow at the end.
Figure 4:
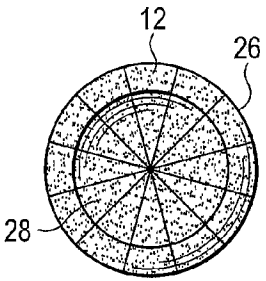
FIG. 4 is a plan view of the top or barrel end of the exemplary embodiment
Figure 3:
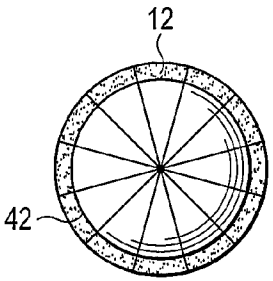
FIG. 3 is a plan view of the bottom or knob end of the exemplary embodiment.

In a two-wood bat, the two different woods should be joined securely to make a bat capable of withstanding the enormous stress of striking a fastball. This may be accomplished by a longitudinally overlapping arrangement of the battens as shown in FIGS. 1, 5, and 6. In this arrangement, the shortest and longest battens 12*a* and 12*c* are aligned with each other, and the remaining battens 12*b* and 12*d* are aligned with each other. In addition, a miter cut may be made on the adjoining ends of all battens to increase the glue-coated area of the joint 34 as shown in FIG. 2. One of the battens in an aligned pair can receive an acute angle miter cut, preferably about 30 degrees relative to the axis 48 as shown in FIG. 2, while the corresponding batten will receive a supplementary angle cut for a close fit. Preferably, this cut is made so that the longer portion of the lower batten 12*c* or 12*d* comprising the handle 24 is located near the axis, while the longer portion of the upper batten 12*a* or 12*b* comprising the barrel 26 is towards the outside of the bat, as shown in FIG. 2. In this way, a ball striking the bat 10 tends to put a compressive, rather than tensile, stress on the glue joint.

After cutting, the sets of battens may be weighed and paired for balance, as in the single-wood bat. The faces 32 are then coated with glue, and the bat is assembled as before, except that in place of a single batten running the full length of the bat, each layer comprises a pair of battens, meeting at joints 34, as best shown in FIGS. 2 and 5. The lengths of the upper and lower battens are alternated, such that when one batten pair is comprised of a shorter handle batten 12*d* and a longer barrel batten 12*b*, the next layer will be comprised of a longer handle batten 12*c* and a shorter barrel batten 12*a*. In this way the joints 34 are offset longitudinally, yielding a stronger bat, but the blank 30 is still unitary and solid, without air gaps.

When the blank 30 has been assembled, it is wrapped in a barrier material and clamped with hose clamps. In addition, a clamp may be applied to press the ends of the blank together, forcing the mitered joints 34 of the battens into close contact. Bar clamps of suitable length are well known those skilled in the art. The blank 30 is then allowed to cure and machined to form the bat 10.

In the preferred embodiment, the handle 24 is constructed from hickory and the barrel 26 is constructed of sapele. The densities of these woods, given in ounces per cubic inch, are about 0.45 to 0.55 for hickory, and about 0.35 to 0.37 for sapele. Hickory is unusually strong, with an impact bending strength above 55 inches for most species and as high as 104 for one, when tested in accordance with ASTM D143-94 (2007), section 10. Other woods such as ash, maple, or birch, are significantly less resistant to impact, with most species having impact bending strengths below 40 and none being higher than 60 inches. Ash, maple, and birch may also be employed for the barrel, but with densities ranging from 0.38 to 0.41 oz/cu inch, but they do not give as desirable a swing-weight as sapele, which combines high hardness and shear strength with its lower density. The all-sapele barrel portion 36 (FIG. 1) comprises about 24+/−10% of the length of the bat, the overlapping joint portion 38 comprises about 16+/−10%, and the all-hickory handle portion 40 comprises about 60+/−10%. The mid-spec values for these lengths and densities yields a bat with its center of gravity 46 (FIG. 2) about 62% of the distance from the end of the knob 42 to the end 44. This results in a moment of inertia that is comparable to a conventional bat cut from a single blank of maple, despite higher overall weight and higher strength. In addition, due to the use of hickory and the symmetrical arrangement of the grain lines 16 in the laminated design of the preferred bat, its propensity to break is greatly reduced. Finally, when the bat of the present invention does break, it is less likely to do so catastrophically, sending heavy and sharp pieces of bat through the air. More typically, a few battens will break, leaving the remaining battens to hold the bat in one piece, improving player and spectator safety.

The precise final dimensions and woods are chosen with two main goals in mind. First, the bat preferably should have a moment of inertia, and therefore a "swingweight," comparable to wooden bats of the same size which are already in common use. The moment of inertia may be varied by varying the density of the woods involved and their distances from the knob 42—higher densities and higher distances yielding higher moments. A further means of controlling swingweight is changing the lengths of the respective sections, to alter the quantity of low-density wood in the bat. In addition, it is not necessary to make an entire section out of a single wood; some of the battens in a given section could be made of one type of wood, while others were made of another. For instance, including a few hickory battens in the barrel along with the sapele already present would increase the swing-weight of the bat, which some batters might find preferable. Regardless of how the adjustment is made, when a greater proportion of the barrel is composed of a lighter wood, and/or the center of gravity 46 is moved towards the knob 42, the moment of inertia will be lower, and vice versa. The second goal is structural integrity. When a bat strikes a baseball, temporary forces as high as 8,000 pounds per square inch are encountered. The result is bat vibration, invisible to the unaided eye, but visible on high-speed video or stroboscopic photographs. The joint portion of the bat, where the two woods overlap, should not cover an area of the bat that experiences the sharpest bends; rather, that area is preferably entirely hickory, to take advantage of hickory's very high strength. The wood choices, densities, and proportions as given above for the preferred embodiment satisfy both of these criteria, but other combinations are possible.

The terms and expressions that have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. A wooden bat, comprising:

a. a handle section including a first wood; and b. a barrel section including a second wood;

c. wherein said handle and barrel sections are securely joined together; and d. wherein said first wood has a higher density than said second wood; and e. wherein said bat further comprises a longitudinal axis and a plurality of elongate wood battens extending along said axis, said battens meeting transversally with each other along surfaces extending substantially radially outward from said axis; and f. wherein the wood of said battens has a grain that is substantially cylindrically symmetrical about said axis.

2. The bat of claim 1, wherein said first wood has an average density of about 0.45 to 0.55 ounces per cubic inch, and said second wood has an average density of about 0.35 to 0.37 ounces per cubic inch.

3. The bat of claim 1, wherein said first wood is hickory.

4. The bat of claim 1, wherein said second wood is sapele.

5. The bat of claim 1, said bat having a length, further comprising a joint section where said first and second woods overlap, wherein said handle section is about 50-70% of the length of the bat, said joint section is about 6-26% of the length of the bat, and said barrel section is about 14-34% of the length of the bat.

6. The bat of claim 1, said bat having a length, wherein the center of gravity of the bat is located about 62% of the length of the bat, as measured from an end proximate said handle section.

7. The bat of claim 1, wherein:

a. said handle and barrel sections each contain respective cylindrical portions and respective joint portions;

b. said cylindrical portions are substantially cylindrically symmetrical about a longitudinal axis of said bat and substantially solid;

c. said respective joint portions each comprise wedges of wood arranged about said axis, each of said wedges having two longitudinally extending sides converging radially toward said axis, at least two of said wedges being separated from one another by a wedge-shaped space; and d. said respective joint portions being so constructed as to join matingly with each other, with the wedges from said handle section filling the spaces between the wedges of said barrel section, and vice versa, so that the sections, when joined, create a substantially solid bat.

8. A wooden bat, comprising:

a. a first section including a handle; and b. a second section including a barrel; wherein, c. said first and second sections each contain respective cylindrical portions and respective joint portions;

d. said cylindrical portions are substantially cylindrically symmetrical about a longitudinal axis of said bat and so constructed as to be substantially free of air gaps;

e. said respective joint portions each comprise wedges of wood arranged about said axis, each of said wedges having two longitudinally extending sides converging radially toward said axis, at least two of said wedges being separated from one another by a wedge-shaped space;

f. said respective joint portions being so constructed as to join matingly with each other, with the wedges from said handle section filling the spaces between the wedges of said barrel section, and vice versa, so that the sections, when joined, create a substantially solid bat;

g. wherein said bat comprises a plurality of elongate wood battens extending along said axis, said battens meeting transversally with each other along surfaces extending substantially radially outward from said axis; and h. wherein the wood of said battens has a grain that is substantially cylindrically symmetrical about said axis.

9. The bat of claim 8, wherein said first section is of a greater average density than said second section.

10. The bat of claim 9, wherein said first section includes a first wood having a density of between about 0.45 and 0.55 ounces per cubic inch, and said section includes a second wood having a density between about 0.35 and 0.37 ounces per cubic inch.

11. The bat of claim 8 wherein said first section includes wood having an impact bending strength of at least 60 inches, measured according to ASTM D143-94 (2007), section 10.

12. The bat of claim 8, wherein said first section includes hickory.

13. The bat of claim 8, wherein said second section includes sapele.

14. A method of making a wooden bat, comprising the steps of:

a. providing a sufficient number of elongate wedge-shaped battens to form an approximately cylindrical blank around an axis, each of said battens having two faces which extend longitudinally, said faces each having two longitudinal margins and outer portions adjacent said margins, and a central portion located between said outer portions;

b. removing material from the central portions of the faces of each of said battens, leaving the outer portions undisturbed;

c. applying glue to the faces of said battens;

d. assembling said battens to form the cylindrical blank by disposing the battens about the axis and placing said outer portions of said battens proximate one another, glue filling the spaces between said central portions of neighboring battens;

e. clamping the assembled blank so as to provide a radially inwardly directed force on the blank while the glue hardens; and f. machining the blank to form a desired shape for the bat.

15. The method of claim 14, wherein said battens comprise at least two different species of wood that meet at a joint.

16. The method of claim 15, wherein a first wood species has a density of between about 0.45 and 0.55 ounces per cubic inch, and a second wood species has a density between about 0.35 and 0.37 ounces per cubic inch.

17. The method of claim 15, wherein said joint is a miter joint.

18. The method of claim 17, wherein the joint is formed at an angle of 30 degrees from said axis.

19. The method of claim 15, wherein the two woods are hickory and sapele.

20. The method of claim 15, wherein said blank is so assembled such that the joints of neighboring battens are not adjacent one another.

21. The method of claim 14, wherein said battens includes wood having an impact bending strength of at least 60 inches, measured according to ASTM D143-94 (2007), section 10.

22. A method for making a wooden bat, comprising the steps of:

a. providing at least a first and a second set of elongate wedge-shaped battens, each set sufficient to form an approximately cylindrical blank, said battens each having longitudinally extending faces and an end;

b. applying glue to the faces of said battens;

c. assembling said battens to form the cylindrical blank by disposing the battens about a longitudinal axis;

d. alternating the placement of said battens within said first set so that the ends of approximately half of the battens, comprising a first half of said first set, extend a predetermined distance beyond the ends of a second half of said first set of battens, and wedge-shaped spaces exist between said battens of said first half;

e. alternating the placement of said battens within said second set so that the ends of approximately half of the battens, comprising a first half of said second set, extend a predetermined distance beyond the ends of a second half of said second set of battens, and wedge-shaped spaces exist between said battens of said first half;

f. disposing the two sets so that the first half of the battens of each set extend into and substantially fill the spaces found between the first half of the battens of the other set, the ends of said respective first halves being proximate the ends of said respective second halves, thereby forming a unitary substantially cylindrical blank comprised of both sets of battens;

g. clamping the blank so as to provide a radially inwardly directed force on the blank while the glue hardens;

h. clamping the ends of the blank to provide a longitudinally inwardly directed force on the blank while the glue hardens; and i. machining the blank to form a desired shape for the bat.

23. The method of claim 22 wherein:

a. said faces each have two longitudinal margins and outer portions adjacent said margins, and a central portion located between said outer portions;

b. further comprising the step of removing a small amount of material from the central portions of the faces of each of said battens, leaving the outer portions undisturbed.

24. The method of claim 22, wherein said first set is constructed of a first species of wood, and said second set is constructed of a second species of wood.

25. The method of claim 24, wherein said first set includes wood having an impact bending strength of at least 60 inches, measured according to ASTM D143-94 (2007), section 10.

26. The method of claim 24, wherein the two woods are hickory and sapele.

27. The method of claim 22, wherein said ends of said first set of battens are cut at an angle other than 90 degrees relative to said axis, and said ends of said second set are cut at a supplementary angle such that the ends meet matingly to form a unitary blank.

28. The method of claim 27, wherein the ends of said first set are at an angle of 30 degrees from said axis.

* * * * *